US010842328B2

(12) United States Patent
Williams

(10) Patent No.: US 10,842,328 B2
(45) Date of Patent: Nov. 24, 2020

(54) TOILET/SHOWER COMBINATION FIXTURE

(71) Applicant: Wilco Partnership, LLC, Vernal, UT (US)

(72) Inventor: Gregg Williams, Vernal, UT (US)

(73) Assignee: Wilco Partnership, LLC, Vernal, UT (US)

( * ) Notice: Subject to any disclaimer, the term of this patent is extended or adjusted under 35 U.S.C. 154(b) by 91 days.

(21) Appl. No.: 15/940,353

(22) Filed: Mar. 29, 2018

(65) Prior Publication Data

US 2019/0099046 A1 Apr. 4, 2019

Related U.S. Application Data

(60) Provisional application No. 62/479,146, filed on Mar. 30, 2017, provisional application No. 62/556,790, filed on Sep. 11, 2017.

(51) Int. Cl.

| | |
|---|---|
| ***A47K 4/00*** | (2006.01) |
| ***A47K 3/28*** | (2006.01) |
| ***A47K 3/34*** | (2006.01) |
| ***A47K 3/32*** | (2006.01) |

(52) U.S. Cl.

CPC ..... *A47K 4/00* (2013.01); *A47K 3/282* (2013.01); *A47K 3/284* (2013.01); *A47K 3/34* (2013.01); *A47K 3/325* (2013.01)

(58) Field of Classification Search

CPC ..... A47K 4/00; A47K 3/282; A47K 3/284; A47K 3/34; A47K 3/325

USPC ..... 4/663, 252.2

See application file for complete search history.

(56) References Cited

U.S. PATENT DOCUMENTS

| | | | | |
|---|---|---|---|---|
| 1,471,154 | A * | 10/1923 | Graham | E03D 11/14 4/252.2 |
| 4,112,524 | A * | 9/1978 | Johansson | A47K 3/006 4/664 |
| 4,358,864 | A | 11/1982 | Medrano | |
| 4,680,817 | A * | 7/1987 | Sloan | A47K 4/00 4/663 |
| 4,718,131 | A * | 1/1988 | Kitamura | A47K 4/00 4/307 |
| 4,807,310 | A | 2/1989 | Sedala | |
| 4,821,348 | A | 4/1989 | Pauna | |
| 6,185,759 | B1 | 2/2001 | Staudenmayer | |
| 7,802,323 | B2 | 9/2010 | Al-Mutairi | |
| 2003/0140571 | A1 | 7/2003 | Muha | |
| 2006/0087097 | A1* | 4/2006 | Kramer | A47K 3/282 280/304.1 |
| 2008/0289099 | A1* | 11/2008 | Skinner | A47K 4/00 4/664 |
| 2013/0232685 | A1* | 9/2013 | Cornille | A47K 4/00 4/663 |

FOREIGN PATENT DOCUMENTS

| | | |
|---|---|---|
| CN | 203379056 | 1/2014 |

OTHER PUBLICATIONS

PCT Search Report and Opinion for PCT/US2018/25202 dated Jun. 28, 2018.

* cited by examiner

*Primary Examiner* — Tuan N Nguyen

(74) *Attorney, Agent, or Firm* — Remenick PLLC

(57) ABSTRACT

A combination shower and toilet is disclosed. The device comprises a base, a toilet bowl extending from the base, a shower head coupled to the base, a pivoting curtain rod coupled to the base, and a shower curtain coupled to the curtain rod.

14 Claims, 5 Drawing Sheets

TOILET/SHOWER COMBINATION FIXTURE

REFERENCE TO RELATED APPLICATION

This application claims priority to U.S. Provisional Application Nos. 62/479,146, filed Mar. 30, 2017, and 62/556,790, filed Sep. 11, 2017, both entitled "Toilet/Shower Combination Fixture" and both are entirely incorporated by reference.

BACKGROUND

1. Field of the Invention

This invention is directed to systems and devices for providing a combination toilet and shower. Specifically, the invention is directed to systems and devices for assisting washing infirm people using a combination toilet and shower.

2. Description of the Background

The invention relates generally to bathroom equipment and accessories, and in particular to a toilet/shower combination fixture. For elderly and disabled persons who are seeking to continue living independently, as well as the adult children of elderly and disabled persons who choose to continue living at home, daily bathroom tasks can become a serious challenge. Using a toilet and getting a daily shower, without any falls or other incidents, has never been more important. Due to the increasing number of families providing in-home care for their loved ones, and the rising costs of professional care, many challenges have arisen from bathroom use. Various specialized bathroom fixtures and devices have been developed for such users, but they are generally very expensive and require a substantial amount of floor space. Thus, each design has proven to be less than satisfactory in its own way. A simple and inexpensive device which combines the functions of a toilet and a shower, and enables the elderly or disabled user to take care of personal hygiene needs and continue living at home without significant assistance or provides a caretaker with the ability to assist in washing the infirm person, would be well received. A toilet/shower combination fixture, which may be easily and quickly reconfigured into either a toilet or a shower without the use of tools, would resolve this problem.

SUMMARY

The present invention overcomes the problems and disadvantages associated with current strategies and designs and provides new devices and systems for providing a shower toilet combination.

One embodiment of the invention is directed to a combination shower and toilet. The device comprises a base, a toilet bowl extending from the base, a shower head coupled to the base, a pivoting curtain rod coupled to the base, and a shower curtain coupled to the curtain rod.

Preferably, the device further comprises at least one of a toilet seat and a toilet lid coupled to the toilet bowl. In a preferred embodiment, the device further comprises at least one water source connection. The at least one water source connection is preferably a hose adapted to connect to a sink or bathtub faucet or a receptacle adapted to be connected to existing plumbing.

Preferably, the combination shower and toilet is adapted to replace an existing toilet. In a preferred embodiment, the shower head is retractable. Preferably, the shower head comprises a water flow control device. Preferably, the base comprises a basin with a drain adapted to connect to an existing sewer drain. The pivoting curtain rod preferably pivots between a vertical position and a horizontal position. The shower curtain is preferably at least one of removable, washable, and mold-resistant. Preferably, the device further comprises at least one handrail.

Other embodiments and advantages of the invention are set forth in part in the description, which follows, and in part, may be obvious from this description, or may be learned from the practice of the invention.

DESCRIPTION OF THE INVENTION

Figures 1, 2, 3:
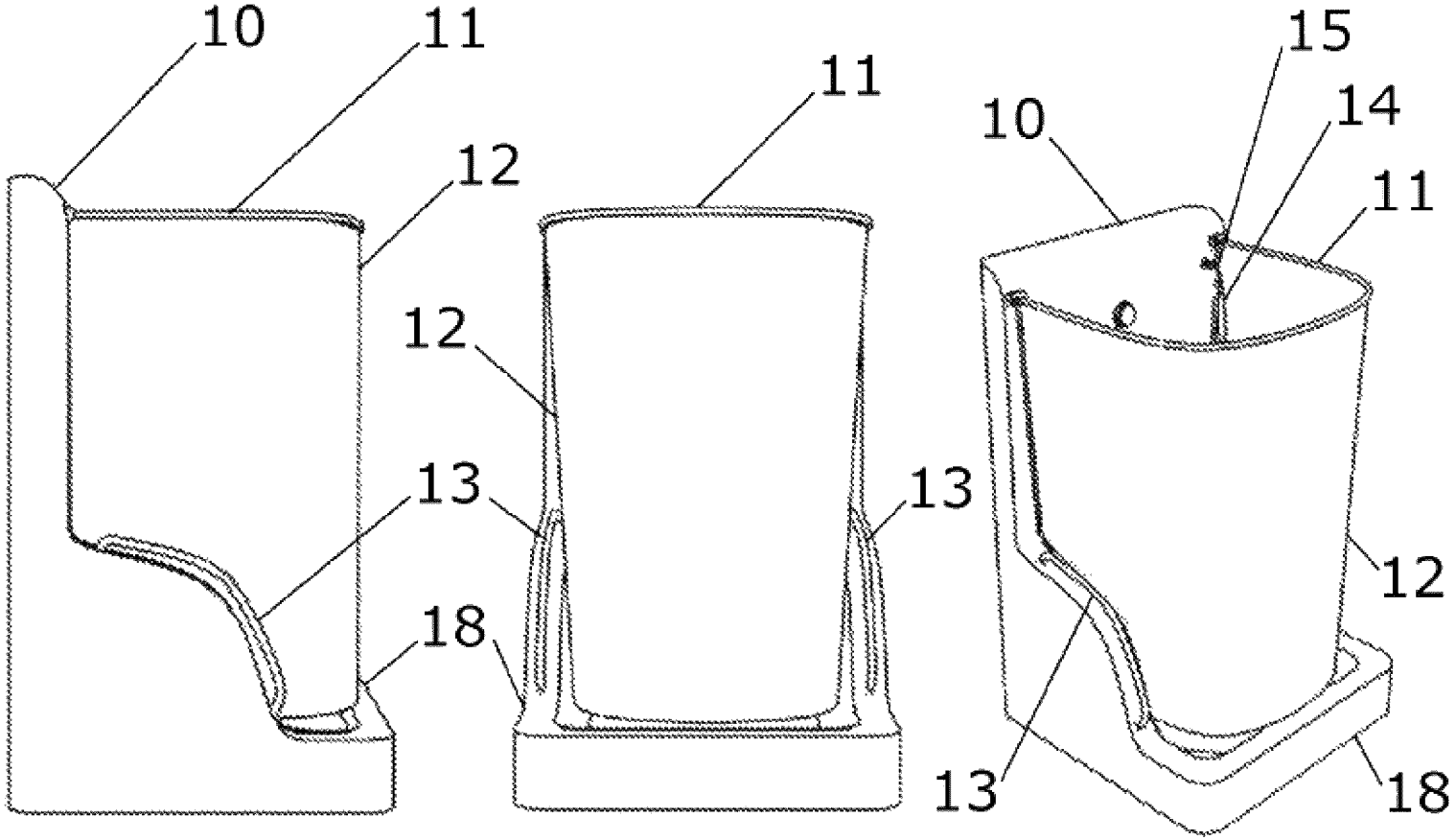
FIG. 1 is a side view of the first exemplary embodiment, displaying the fixture 10, the curtain rod 11, the curtain 12, the handrail 13, and the base 18.
FIG. 2 is a front view of the first exemplary embodiment, displaying the fixture 10, the curtain rod 11, the curtain 12, the handrails 13, and the base 18.
FIG. 3 is a top perspective view of the first exemplary embodiment, displaying the fixture 10, the curtain rod 11, the curtain 12, the handrails 13, the hand-held faucet 14, the hose 15, and the base 18.

It is to be understood that while the invention is intended for use by elderly or disabled adults, this is not intended as a limitation. With suitable modification or with no modification at all, the invention may be used by any person including infants, children, and adults. For example, the device may be used in facilities were space is limited and a combination shower and toilet is desired to have both fixtures within the bathroom. Furthermore, the device may be used to wash a pet or another animal and inanimate objects. It is to be further understood that while the invention is intended for installation as a replacement for an existing toilet, this is not intended as a limitation. The device may additionally replace a bidet, bathtub, shower, sink, or other fixture. Additionally, the device may be installed in an existing bathroom in addition to the existing fixtures. Preferably, the device can be installed without changing the existing structure of the bathroom. For example, the device can preferably be installed without moving or modifying other fixtures (including bathtubs, showers, bidet, vanities, sinks, etc.), without moving, modifying, or cutting into existing walls, without reflooring, and without replumbing or rewiring the structure. Preferably, the device is dimensioned to fit through a standard doorway. With suitable modification or with no modification at all, the invention may be installed as original equipment in a newly constructed or remodeled house or other building. While the device is described as being installed in a bathroom, it can be installed in any room of a house, apartment, or other building. Preferably, the location of installation has access to water. Additionally, the fixture can be uninstalled or removed as a single unit, preferably without changing the existing structure. Furthermore, the device may be usable outside a building on a temporary or permanent basis. In such embodiments, the device may supply its own water or may be couplable to a water tank, fire hydrant, or a garden or other hose. Furthermore, the device may include one or more pumps adapted to retrieve water from natural sources, such as lakes, rivers, ponds, oceans, and streams.

The first exemplary embodiment is comprised of a toilet/shower combination fixture 10 is shown in FIGS. 1-5. The fixture 10 may be connected to any existing toilet plumbing, and provides a hand-held shower head 14 with a retractable quick-connect hose 15 to a water supply in the bathroom. In a preferred embodiment, the water supply is a sink or bathtub faucet. Preferably fixture 10 includes supply hose 19 that is in fluid communication with shower head 14. Supply hose 19 preferably has an adapter 20 that is able to connect to a sink or bathtub faucet or another water source. There may be a plurality of adapters 20 to fit different sized and styled faucets or adapter 20 may be a universal adapter able to fit most or all commercially available faucets. Supply hose 19 may retract into fixture 10 when not in use or fixture 10 may have a storage device (such as a hook or drawer) to store hose 19 when not in use. To control the temperature and flow rate of the water, the sink or bathtubs controls are preferably utilized. However, shower head 14 may have built-in controls and/or a shut-off valve to stop the flow of water without turning off the sink or bathtub faucet. In other embodiments, fixture 10 may come with an external shower hose or other washing device that attached to the bathroom's fixtures without attaching to fixture 10. Such an external hose may be 8', 10', or 12' long.

Figure 5:
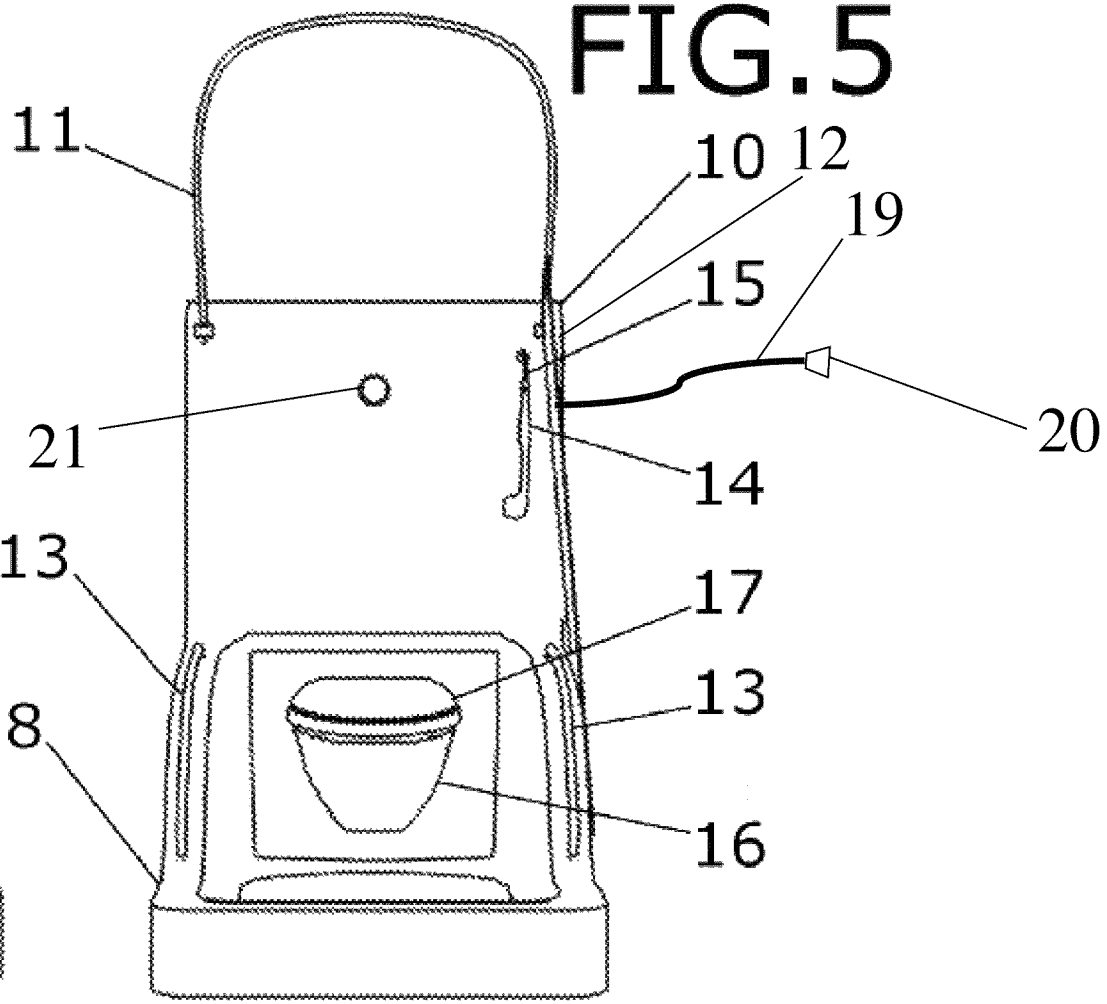
FIG. 5 is a front view of the first exemplary embodiment with the curtain rod folded, displaying the fixture 10, the curtain rod 11, the handrails 13, the hand-held shower head 14, the hose 15, the toilet bowl 16, the toilet lid 17, and the base 18.
Figure 4:
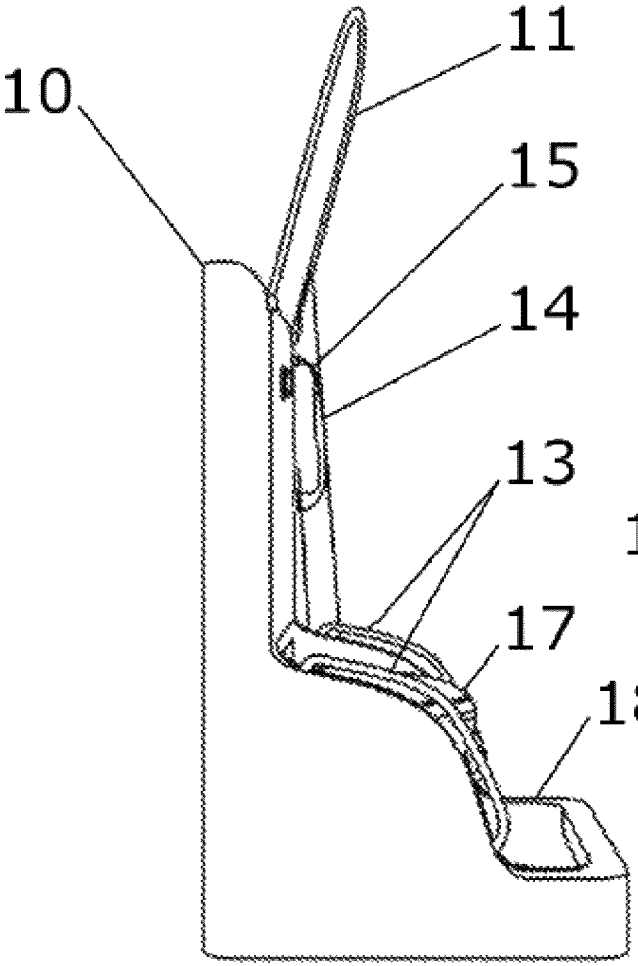
FIG. 4 is a side view of the first exemplary embodiment with the curtain rod folded, displaying the fixture 10, the curtain rod 11, the handrails 13, the hand-held shower head 14, the hose 15, the toilet lid 17, and the base 18.

A hinged curtain rod 11 with a shower curtain 12 may be lifted upward toward the wall behind the fixture 10 when the toilet feature is being used and for entering and exiting fixture 10. In the raised position, shower curtain 12 is preferably tucked alongside of fixture 10, as shown in FIG. 5. In other embodiments, shower curtain 12 is stored separately from fixture 10 or within a storage compartment of fixture 10. Curtain rod 11 is preferably pulled downward to a position perpendicular to the back of fixture 10 when the shower feature is being used. Shower curtain 12 is preferably removable form curtain rod 11 and is made of a washable, water resistant material (for example, plastic, rubber, waxed cotton, nylon, or another fabric). Shower curtain 12 is preferably mold-resistant. Preferably, during use of the shower feature, shower curtain 12 limits the amount of water exiting fixture 10, thereby keeping the rest of the bathroom and any person (e.g. an aid, medical professional, or other helper) outside fixture 10 dry. While one curtain 12 is shown, two or more curtains 12 may be used with fixture 10. Multiple curtains 12 may allow access to the user from different positions without exposing the surrounding area or caretaker to water.

The fixture 10 is preferably self-contained, with a floor drain in a concave base 18 which provides a quick-connect fitting that may be connected to an existing toilet flange. The floor drain provides a two-way flapper valve which may be controlled by water pressure, or manually with a lever, which is provided. Preferably, the fixture provides a center-mounted toilet bowl 16 with a toilet lid 17, an elliptical or round seat, and handrails 13 mounted to the sides of the toilet bowl 16. Preferably, the toilet feature is controlled by button 21. Button 21 may control a mechanism within fixture 10. While a button is shown, a lever or other device may be used. Button 21 may be able to control the size of the flush (e.g. small or large, see the embodiment shown in FIGS. 6-10). Preferably, base 18 houses the tank and plumbing for using the toilet and/or shower. The tank and/or plumbing may be typical toilet fittings or may be specially designed for fixture 10.

Preferably, fixture 10 requires no or little assembly. Fixture 10 may be quickly and easily installed by a plumber or by the homeowner by removing the old toilet and replacing it with fixture 10. Fixture 10 may have one or more access ports to maintain and repair the internal components of fixture 10.

To use the first exemplary embodiment, the user may lift the toilet lid 17, sit down on a toilet seat on top of the bowl 16 to use the toilet feature or sit down on the toilet lid 17, extend the hose 15, and use the hand-held faucet 14 to use the shower feature.

The curtain rod 11, the handrails 13, the hand-held faucet 14, and the floor drain are preferably manufactured from rigid, durable materials which are corrosion resistant, such as stainless steel or plastic. The curtain 12 is preferably manufactured from a flexible, durable material, such as plastic or waterproofed cotton fabric. The hose 15 is preferably manufactured from a flexible, durable material which provides a watertight seal, such as rubber or silicone. The toilet bowl 16, the toilet lid 17, the base 18, and the toilet seat are preferably manufactured from rigid, durable materials, such as porcelain, wood, and plastic. Preferably, the toilet bowl 16 and base 18 are manufactured as one single piece. However, toilet bowl 16 and base 18 may be separate pieces.

In a preferred embodiment, fixture 10 is 28 inches wide, 36 inches deep and between 40 and 45 inches tall. However, fixture 10 may have other dimensions. For example, fixture 10 may be wider or narrower, deeper or shallower, or taller or shorter. Fixture 10 may come in different sizes to accommodate different bathrooms. Furthermore, fixture 10 may be modified to accommodate people with different disabilities. Additionally, the basin of base 18 may have a non-slip coating or a texture that increases friction.

FIGS. 6-10 depict another embodiment of a shower/toilet combination fixture 110. Similar numbers in FIGS. 1-5 and 6-10 represent similar elements. Elements shown in one embodiment may be used in the other embodiment. In the embodiment shown in FIGS. 6-10, fixture 110 may be coupled directly to the bathroom's plumbing. For example, fixture 110 may have receptacles for cold and hot water supply lines. In such embodiments, the toilet 117 and shower head 114 may share water access or may have separate access to water. Fixture 110 may additionally have an internal heating source. In such embodiments, fixture 110 may only be connected to a cold-water supply. In other embodiments, fixture 110 may be coupled directly to the cold-water supply and obtain hot water from a sink or tub as described with respect to the embodiment in FIGS. 1-5. The internal heating source may be gas, electric, chemical, or another source of heat. Fixture 110 may have one or more control knobs 130 or devices to control the temperature and flow rate of the water through hose 115 to shower head 114.

While control nobs 130 are positioned centrally above the toilet in FIGS. 6-10, control nobs 130 can have another location to provide easier access to caretakers and other helpers.

Figures 6, 7, 8:
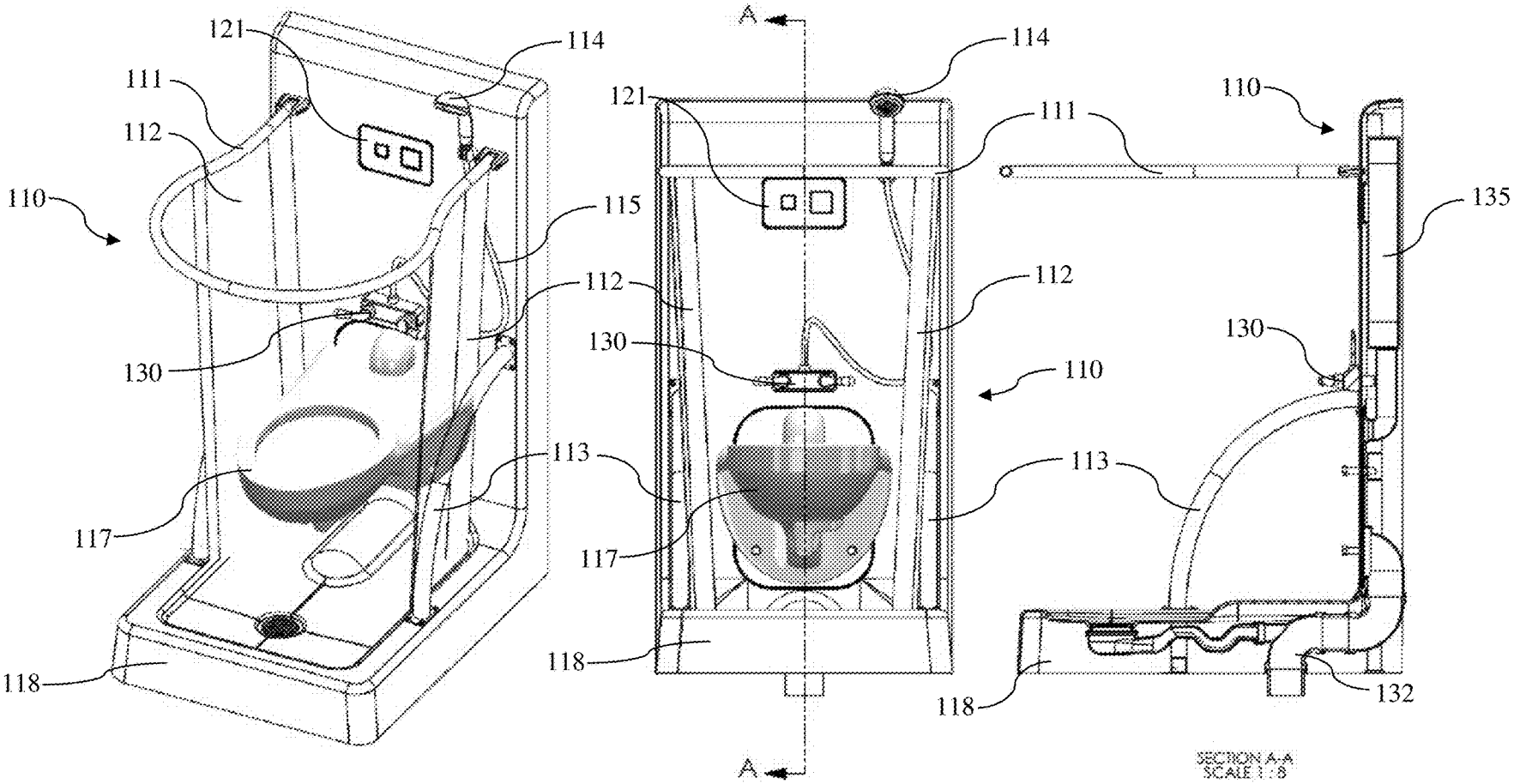
FIG. 6 is a top perspective view of a second exemplary embodiment.
FIG. 7 is a front view of the second exemplary embodiment.
FIG. 8 is a cut-away side view of the second exemplary embodiment (without the toilet).
Figure 9:
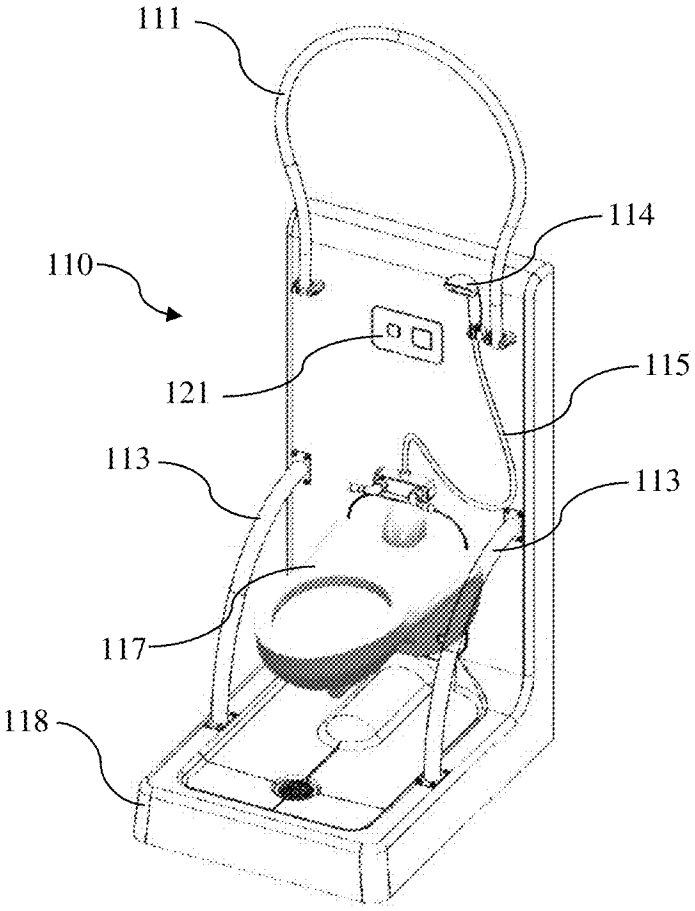
FIG. 9 is a top perspective view of the second exemplary embodiment with the shower curtain rod raised.
Figure 10:
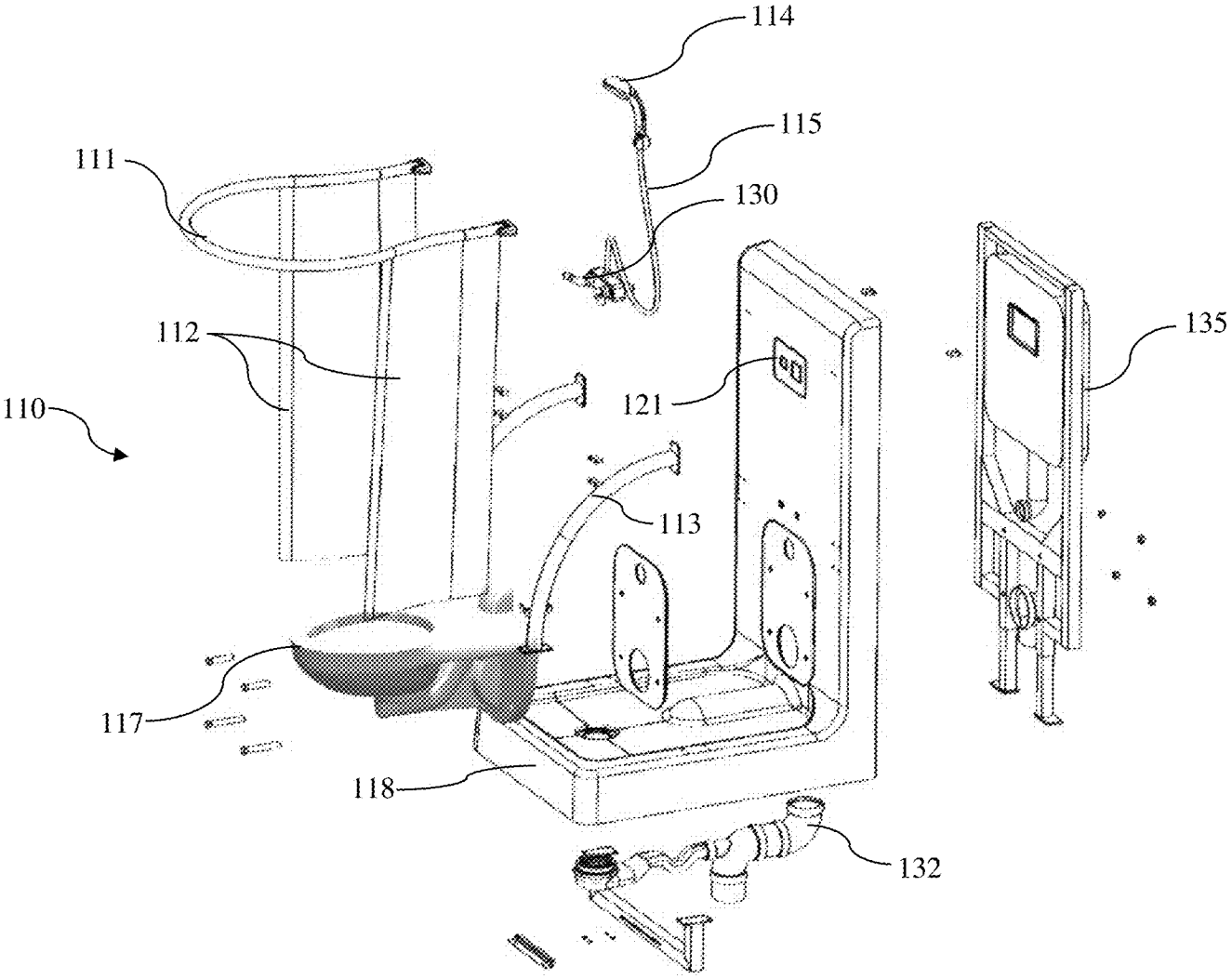
FIG. 10 is an exploded view of the second exemplary embodiment.

Preferably, fixture 110 has a curtain rod 111, shower curtains 112, hand rails 113, and basin 118. Flusher 121 is preferably a two button flusher adapted to provide a small flush with one button and a larger flush with the second button. As can be seen in FIG. 8, basin 118 and toilet 117 preferably share a drainage pipe 132. Additionally, the back of fixture 110 preferably conceals the water tank 135 and associated pluming for toilet 117. Preferably, water tank 135 is a narrow tank adapted to fit within the back structure of fixture 110. Water tank 135 may be a custom designed tank or may be prefabricated design. For example, water tank 135 may be a system designed to be placed within the walls of a bathroom for a traditional, floating toilet.

Other embodiments and uses of the invention will be apparent to those skilled in the art from consideration of the specification and practice of the invention disclosed herein. All references cited herein, including all publications, U.S. and foreign patents and patent applications, are specifically and entirely incorporated by reference. The term comprising, where ever used, is intended to include the terms consisting and consisting essentially of. Furthermore, the terms comprising, including, and containing are not intended to be limiting. It is intended that the specification and examples be considered exemplary only with the true scope and spirit of the invention indicated by the following claims.

The invention claimed is:

1. A combination shower and toilet, comprising:

a base with a floor and a back wall;

a toilet bowl extending from the back wall of the base;

a shower head coupled to the back wall of the base;

a pivoting curtain rod coupled to the back wall of the base;

at least one shower curtain coupled to the curtain rod;

a toilet drain extending, within the base, from behind the back wall to, within the base, below the floor and adapted to couple to a toilet flange below the floor;

wherein the floor comprises a basin with a basin drain positioned below the floor and within the base and adapted to connect to the toilet drain.

2. The combination shower and toilet of claim 1, further comprising at least one of a toilet seat and a toilet lid coupled to the toilet bowl.

3. The combination shower and toilet of claim 1, further comprising at least one external water source connection.

4. The combination shower and toilet of claim 3, wherein the at least one external water source connection is a hose adapted to connect to a sink faucet or bathtub faucet.

5. The combination shower and toilet of claim 3, wherein the at least one water source connection is a receptacle adapted to be connected to existing plumbing.

6. The combination shower and toilet of claim 3, wherein there is only one external water source connection and the one external water source connection is a cold-water connection.

7. The combination shower and toilet of claim 6, further comprising a water heater.

8. The combination shower and toilet of claim 1, wherein the combination shower and toilet is a single unit adapted to replace an existing toilet.

9. The combination shower and toilet of claim 1, wherein the shower head is retractable.

10. The combination shower and toilet of claim 1, wherein the shower head comprises a water flow control device.

11. The combination shower and toilet of claim 1, wherein the pivoting curtain rod pivots between a vertical position and a horizontal position.

12. The combination shower and toilet of claim 1, wherein the at least one shower curtain is at least one of removable, washable, and mold-resistant.

13. The combination shower and toilet of claim 1, further comprising at least one handrail coupled to the back wall and the floor.

14. The combination shower and toilet of claim 1, further comprising a water tank coupled to the toilet bowl, wherein the water tank is housed within the base behind the back wall.

* * * * *